US008235451B2

(12) United States Patent
Jordan et al.

(10) Patent No.: US 8,235,451 B2
(45) Date of Patent: Aug. 7, 2012

(54) METHOD AND SYSTEM FOR DEFORMING A DRIVE ROD IN A DOOR AFTER AN IMPACT TO THE DOOR

(75) Inventors: Nathaniel P. Jordan, Ann Arbor, MI (US); Christopher M. Higgins, Ypsilanti, MI (US); Jessica A. Riffe, Pickney, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 260 days.

(21) Appl. No.: 12/618,928

(22) Filed: Nov. 16, 2009

(65) Prior Publication Data

US 2011/0115251 A1 May 19, 2011

(51) Int. Cl.
*E05C 9/10* (2006.01)

(52) U.S. Cl. ..... 296/146.1; 292/259 A; 296/187.12

(58) Field of Classification Search ..... 292/53, 292/86, 259 A, DIG. 23, DIG. 41; 296/146.1, 296/187.12; 49/502, 503
See application file for complete search history.

(56) References Cited

U.S. PATENT DOCUMENTS

| | | | | |
|---|---|---|---|---|
| 3,596,956 | A | | 8/1971 | Yoshie |
| 4,466,645 | A | | 8/1984 | Kobayashi |
| 4,497,514 | A | | 2/1985 | Moriya et al. |
| 4,580,821 | A | | 4/1986 | Genord, Jr. et al. |
| 4,775,176 | A | | 10/1988 | Ikeda |
| 5,058,938 | A | | 10/1991 | Doring et al. |
| 5,069,493 | A | * | 12/1991 | Mochida et al. ..... 292/336.3 |
| 5,154,457 | A | | 10/1992 | Watanabe |
| 5,253,906 | A | | 10/1993 | Rogers, Jr. et al. |
| 5,265,920 | A | | 11/1993 | Kaup et al. |
| 5,431,462 | A | * | 7/1995 | Lignell ..... 292/336.3 |
| 5,492,379 | A | * | 2/1996 | Staser et al. ..... 292/336.3 |
| 5,584,516 | A | | 12/1996 | Cetnar |
| 5,782,114 | A | | 7/1998 | Zeus et al. |
| 5,855,400 | A | | 1/1999 | Ohhashi et al. |
| 6,065,797 | A | | 5/2000 | Shirasaka |
| 6,155,618 | A | | 12/2000 | Ichinose |
| 6,168,216 | B1 | | 1/2001 | Nakajima et al. |
| 6,419,286 | B1 | | 7/2002 | Szablewski |
| 6,428,058 | B1 | | 8/2002 | Graute |
| 6,464,270 | B1 | | 10/2002 | Sloan et al. |
| 6,519,986 | B2 | | 2/2003 | Wicker |
| 6,685,239 | B2 | | 2/2004 | Yamauchi et al. |

(Continued)

FOREIGN PATENT DOCUMENTS

| | | |
|---|---|---|
| EP | 0013255 | 7/1980 |

(Continued)

*Primary Examiner* — Glenn Dayoan
*Assistant Examiner* — Paul Chenevert
(74) *Attorney, Agent, or Firm* — Snell & Wilmer LLP

(57) ABSTRACT

A method and system for deforming a drive rod in a door after an impact to the door. An automobile having a door with a door handle, a drive rod, a latching system, a striker, and a drive rod deformation member. The drive rod deformation member can be positioned adjacent to the drive rod. Upon impact to the door, the drive rod deformation member impacts and deforms the drive rod. The deformation of the drive rod can correspond to a compression of the door and the door can be opened by actuating the door handle. However, the deformation of the drive rod prevents the drive rod from controlling the latching system to disengage from the striker through compression of the door.

18 Claims, 7 Drawing Sheets

U.S. PATENT DOCUMENTS

| | | | | |
|---|---|---|---|---|
| 6,779,820 | B2 | 8/2004 | Ogino | |
| 6,810,699 | B2 | 11/2004 | Nagy | |
| 6,880,866 | B2 | 4/2005 | Tomaszewski et al. | |
| 6,880,867 | B2 * | 4/2005 | Schoen et al. | 292/216 |
| 6,929,293 | B2 | 8/2005 | Tonges | |
| 7,128,349 | B2 | 10/2006 | Bendel et al. | |
| 7,159,907 | B2 | 1/2007 | Song | |
| 7,224,259 | B2 | 5/2007 | Belmond et al. | |
| 7,303,224 | B2 * | 12/2007 | Kim | 296/76 |
| 7,380,845 | B2 | 6/2008 | Suzumura et al. | |
| 7,789,455 | B2 * | 9/2010 | Hall et al. | 296/187.05 |
| 8,128,151 | B2 * | 3/2012 | Teramoto et al. | 296/146.1 |
| 2003/0160462 | A1 | 8/2003 | Tonges | |
| 2004/0201229 | A1 | 10/2004 | Shabana et al. | |
| 2005/0012345 | A1 | 1/2005 | Saitoh | |
| 2005/0146147 | A1 | 7/2005 | Niskanen et al. | |
| 2006/0103145 | A1 | 5/2006 | Ottolini et al. | |
| 2006/0175845 | A1 | 8/2006 | Arabia, Jr. et al. | |
| 2006/0261602 | A1 | 11/2006 | Jankowski et al. | |
| 2007/0029835 | A1 * | 2/2007 | Herline et al. | 296/146.1 |
| 2007/0069525 | A1 | 3/2007 | Ghannam | |
| 2007/0158954 | A1 | 7/2007 | Warmke et al. | |
| 2007/0182165 | A1 | 8/2007 | Yoshikuwa et al. | |
| 2008/0185850 | A1 * | 8/2008 | Takaya et al. | 292/336.3 |
| 2008/0277947 | A1 | 11/2008 | Costigan | |
| 2009/0064591 | A1 * | 3/2009 | Keller et al. | 49/358 |
| 2009/0224569 | A1 * | 9/2009 | Lagrut | 296/146.1 |
| 2010/0019512 | A1 * | 1/2010 | Gschweng et al. | 292/217 |
| 2010/0109350 | A1 * | 5/2010 | Gschweng et al. | 292/196 |
| 2011/0062747 | A1 * | 3/2011 | Teramoto et al. | 296/146.1 |
| 2011/0115251 | A1 * | 5/2011 | Jordan et al. | 296/146.1 |
| 2011/0115252 | A1 * | 5/2011 | Higgins et al. | 296/146.1 |
| 2011/0258935 | A1 * | 10/2011 | Heller | 49/502 |

FOREIGN PATENT DOCUMENTS

| | | | |
|---|---|---|---|
| GB | 2275727 | | 9/1994 |
| GB | 2361675 | | 10/2001 |
| GB | 2361675 | A * | 10/2001 |
| JP | 2001-262901 | | 9/2001 |
| JP | 2009024328 | | 2/2009 |
| KR | 2001087451 | | 9/2001 |
| KR | 2001087451 | A * | 9/2001 |
| KR | 765836 | | 10/2007 |
| KR | 765836 | B1 * | 10/2007 |
| WO | WO 82/00848 | | 3/1982 |

* cited by examiner

METHOD AND SYSTEM FOR DEFORMING A DRIVE ROD IN A DOOR AFTER AN IMPACT TO THE DOOR

BACKGROUND

1. Field of the Invention

The present invention relates to a method and system for deforming a drive rod in a door after an impact to the door.

2. Description of the Related Art

A conventional automobile includes a conventional door that opens in an outward direction. The conventional door is opened using a handle, a drive rod, a latching system, and a striker. Actuation of the handle moves the drive rod, which in turn controls the latching system to engage or disengage from the striker. During an accident where there is an impact to the door, the door can be deformed and compressed. The deformation and compression will move the latching system closer to the handle such that the drive rod permanently actuates the latching system to disengage from the striker, causing the door to be in a permanent or semi-permanent open position. Having the door be left permanently or semi-permanently open is undesirable. Furthermore, some solutions permanently disable the drive rod. However, in such situations, the door may not be opened when the door handle is actuated.

Thus, there is a need for a method and system for deforming a drive rod in a door after an impact to the door.

SUMMARY

The present invention is a method and system for deforming a drive rod in a door after an impact to the door. The present invention includes an automobile having a door with a door handle, a drive rod, a latching system, a striker, and a drive rod deformation member. The drive rod deformation member can be positioned adjacent to the drive rod. Upon impact to the door, the drive rod deformation member impacts and deforms the drive rod. The deformation of the drive rod corresponds to a compression of the door. The deformation of the drive rod prevents the drive rod from controlling the latching system to disengage from the striker through compression of the door. This allows the door to remain in the closed position instead of the open position prior to actuations by the door handle. Furthermore, the present invention can allow the door to be opened by actuating the door handle, even after the drive rod is impacted by the drive rod deformation member. This can be beneficial, for example, in allowing the user of the automobile to easily exit the automobile, or for other people to access the user of the automobile.

In one embodiment, the present invention is a door latch system including a door, a door handle located on the door, a latch release unit located in the door, a drive rod engaged with the door handle and the latch release unit, and a drive rod deformation member located in the door, wherein upon impact to the door causing deformation to the door, the drive rod deformation member deforms the drive rod.

In another embodiment, the present invention is an automobile including a frame, a striker located in the frame, and a door connected to the frame and selectively engaged with the striker. The door can include a latch unit selectively engaged with the striker, a latch release unit connected to the latch unit, wherein actuation of the latch release unit controls the engagement of the latch unit with the striker, a drive rod engaged to the latch release unit, a door handle engaged to the drive rod wherein the drive rod actuates the latch release unit based on a movement of the handle, and a drive rod deformation member wherein upon impact to the door causing deformation to the door, the drive rod remains engaged with the door handle and the latch release unit, and the drive rod deformation member deforms the drive rod.

In yet another embodiment, the present invention is a method for deforming a drive rod after an impact to the door including impacting the drive rod while the drive rod is connected to a door handle and a latch release unit, and deforming the drive rod while the drive rod remains connected to a door handle and a latch release unit.

BRIEF DESCRIPTION OF THE DRAWINGS

The features, obstacles, and advantages of the present invention will become more apparent from the detailed description set forth below when taken in conjunction with the drawings, wherein.

DETAILED DESCRIPTION

Apparatus, systems and methods that implement the embodiments of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between referenced elements.

Figure 1:
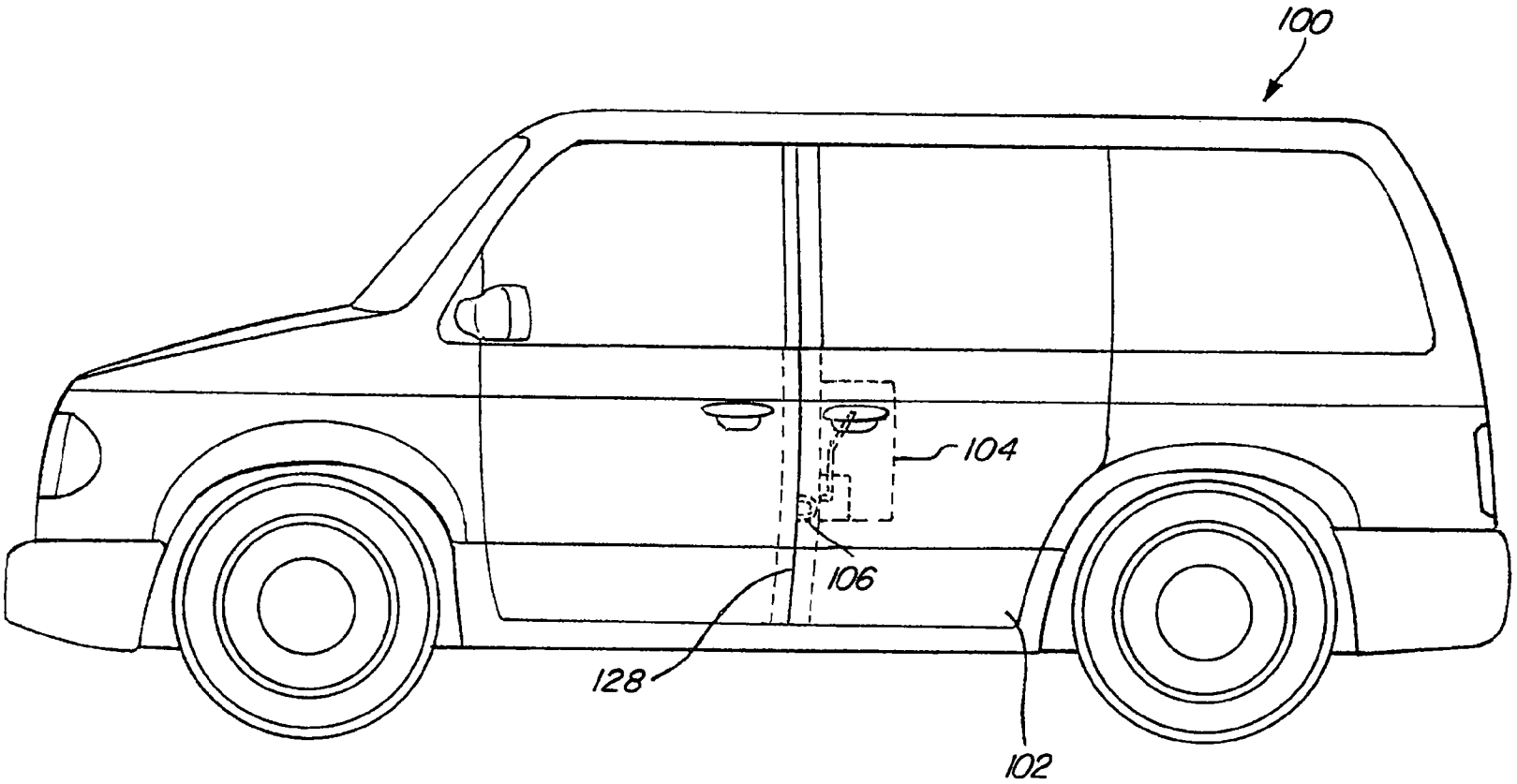
FIG. 1 depicts an automobile including a latching system according to an embodiment of the present invention.

As seen in FIG. 1, a transportation device such as an automobile 100 includes a door 102, a door lock assembly 104, a striker 106, and a frame 128. The automobile 100 can be, for example, a car, a hybrid car, a car with an internal combustion engine, or any other type of vehicle which can be used to transport objects. The striker 106 is connected to the frame 128 of the automobile 100. The door 102 includes the door lock assembly 104, which is selectively engaged to the striker 106. The door 102 can be, for example, a sliding door, or a hinged door. When the door lock assembly 104 is engaged with the striker 106, the door 102 is secured to the frame 128. When the door lock assembly 104 is not engaged with the striker 106, the door 102 can be opened.

Figure 2:
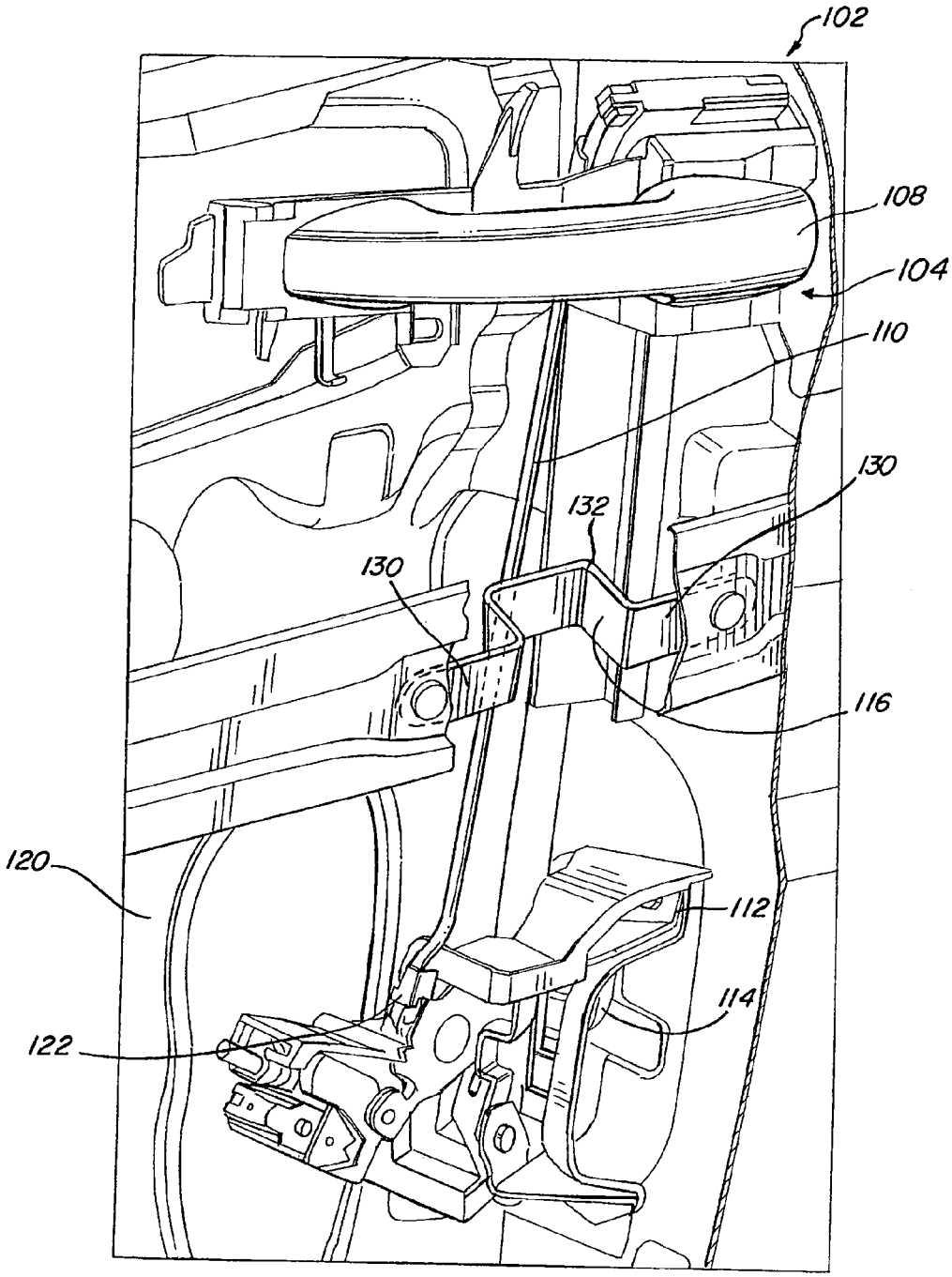
FIG. 2 is a perspective view of a door without an outer panel according to an embodiment of the present invention.
Figure 3:
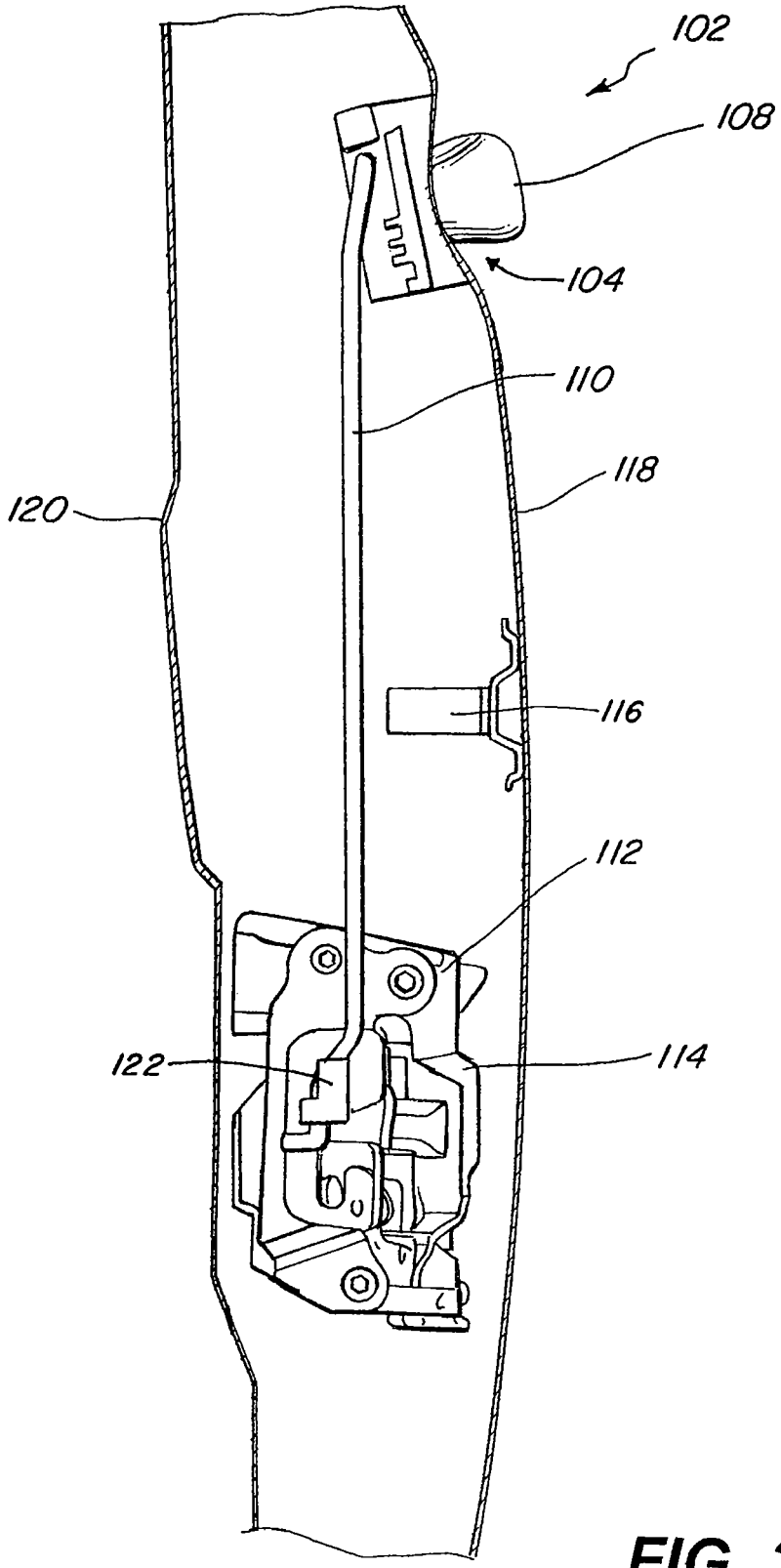
FIG. 3 is a side view of a door according to an embodiment of the present invention.

The door lock assembly 104 can be seen, for example in FIGS. 2 and 3. FIG. 2 is a perspective view of the door 102 without an outer panel, while FIG. 3 is a side view of the door 102. The door 102 in FIG. 3 includes a first panel 118 and a second panel 120. In FIG. 2, only the second panel 120 is shown. The first panel 118 can be, for example, an outer panel, while the second panel 120 can be, for example, an inner panel.

In FIGS. 2 and 3, the door lock assembly 104 can include a door handle 108, a drive rod 110, a drive rod deformation member 116 and/or a latching system 112. The door handle 108 is connected to the first panel 118, and is engaged with the drive rod 110. The drive rod 110 is engaged to the latching system 112 while the latching system 112 is connected to the striker 106 (FIG. 1). The latching system 112 can be located in the door 102 and can be between, for example, the first panel 118 and/or the second panel 120. In one embodiment, the latching system 112 is connected to the second panel 120. The latching system 112 can include, for example, a latch release unit 122 and a latch unit 114. The latch release unit 122 and the latch unit 114 can be separate units or the same unit. In addition, the latch release unit 122 and the latch unit 114 can be integrated together. Furthermore, in one embodiment, the drive rod 110, the latch release unit 122, and/or the latch unit 114 can form a bell crank.

The drive rod deformation member 116 is located in the door 102 and is positioned adjacent to the drive rod 110. For example, the drive rod deformation member 116 can be located on the first panel 118 or the second panel 120. In FIG. 2, the drive rod deformation member 116 can include, for example, an attachment portion 130, and a deformation protrusion 132. However, the drive rod deformation member 116 can be formed from any shape or size such that it is capable of deforming the drive rod 110. In one embodiment, the drive rod deformation member 116 can bend the drive rod 110. The drive rod deformation member 116 can be formed, for example, from steel, plastic, aluminum, an alloy, or any other suitable material with sufficient rigidity to deform the drive rod 110.

Generally, the drive rod deformation member 116 can be located anywhere in or on the door 102 such that it can impact or contact the drive rod 110 when the door 102 is impacted by an object. Although not shown, a cushioning material can be placed between the drive rod deformation member 116 and the drive rod 110. This can ensure that the drive rod deformation member 116 is sufficiently adjacent to the drive rod 110, but will not accidentally contact the drive rod 110 prior to or during an impact to the automobile 100 or disengage the drive rod 110 from the door handle 108 and/or the latching system 112 prior to or during an impact to the door 102.

The drive rod deformation member 116 can impact the drive rod 110 at any point along the drive rod 110 which is sufficient to deform the drive rod 110. For example, the drive rod deformation member 116 can impact the drive rod 110 at a point close to the handle 108, a point close to the latching system 112, and/or a point between the handle 108 and the latching system 112.

In operation, the door handle 108 can be actuated to move the drive rod 110. The movement of the drive rod 110 moves the latch release unit 122, and the latch release unit 122 moves the latch unit 114. The latch unit 114 can be moved to engage with the striker 106 or disengage with the striker 106. The drive rod deformation member 116 ensures that the drive rod 110 is deformed after impact to the automobile 100 and/or the door 102.

In one embodiment, upon impact to the automobile 100 and/or the door 102, the drive rod deformation member 116 contacts the drive rod 110 and deforms the drive rod 110. For example, the deformation protrusion 132 can contact the drive rod 110. By using the deformation protrusion 132, energy from the drive rod deformation member 116 can be produce a sufficient force on the drive rod 110 to bend the drive rod 110, but not an excessive force to disengage the drive rod 110 from the handle 108 and/or the latching system 112. The drive rod 110 can be bent to correspond to a reduced distance between the door handle 108 and the latching system 112 such that the drive rod 110 does not actuate the latching system 112 prior to an actuation of the door handle 108.

Since the drive rod 110 is deformed, the drive rod 110 will not cause the latching system 112 to disengage from the striker 106. This is advantageous when the door 102 deforms and/or compresses such that the door handle 108 is closer to the latching system 112. Conventionally, the reduced distance may cause the drive rod 110 to force the latching system 112 to disengage from the striker 106 in a conventional door. This can simulate, for example, an actuation of the door handle 108, and lead to the opening of the door.

However, since the drive rod 110 is deformed after an impact to the door 102 in the present invention, the drive rod 110 will not cause the latching system 112 to disengage from the striker 106. The bending of the drive rod 110 reduces a direct distance between the two ends of the drive rod 110. This can prevent the door 102 from undesirably opening during or after an accident. This can improve the safety to the users within the automobile 100 and/or prevent further damage to the automobile 100. Furthermore, the deformed drive rod 110 may still be actuated by the door handle 108 allowing the users of the automobile 100 to open the door 102 at the user's convenience. The deformed rive rod 110 may also allow other people external to the automobile, such as rescuers to actuate the door handle 108 and open the door 102 to rescue the users of the automobile 100 or retrieve objects from the automobile 100.

FIGS. 4-8 depict simulations of the door 102 prior to, during, and after an impact with an object 124. The object 124 can be mounted, for example, to an object 126. The object 124 can protrude from the object 126. The objects 124 and/or 126 can simulate an impact with real life objects such as another automobile, a wall, a tree, or any other object which can cause damage to the door 102.

Figure 4:
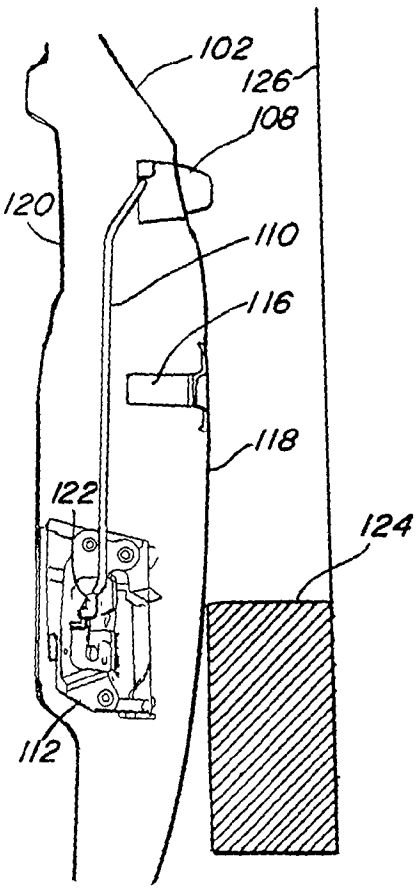
FIG. 4 is a side view of a door prior to an impact with an object according to an embodiment of the present invention.

FIG. 4 depicts the door 102 prior to the impact with the object 124. As can be seen in FIG. 4, the drive rod 110 is engaged with the door handle 108 and the latching system 112. The drive rod deformation member 116, for example, has not deformed the drive rod 110. Thus, the drive rod 110 is not causing the latching system 112 to be disengaged with the striker 106 without actuations from the door handle 108 (FIG. 1).

Figure 5:
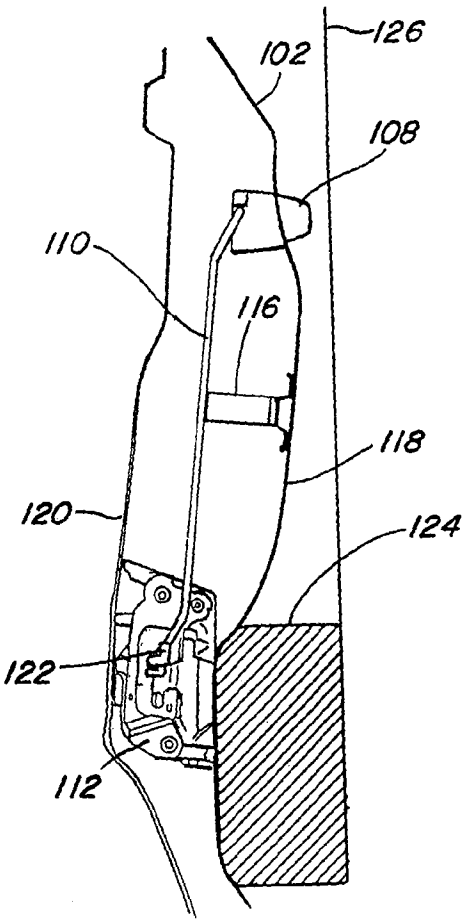
FIG. 5 is a side view of a door during an impact with an object according to an embodiment of the present invention.

FIG. 5 depicts the door 102 immediately after impact with the object 124. The first panel 118 begins to deform due to the impact with the object 124. The deformation of the first panel 118 causes the latching system 112 to move closer to the second panel 120. The deformation of the first panel 118 can also cause the latching system 112 to move closer to the door handle 108. The drive rod deformation member 116 contacts the drive rod 110.

Figure 6:
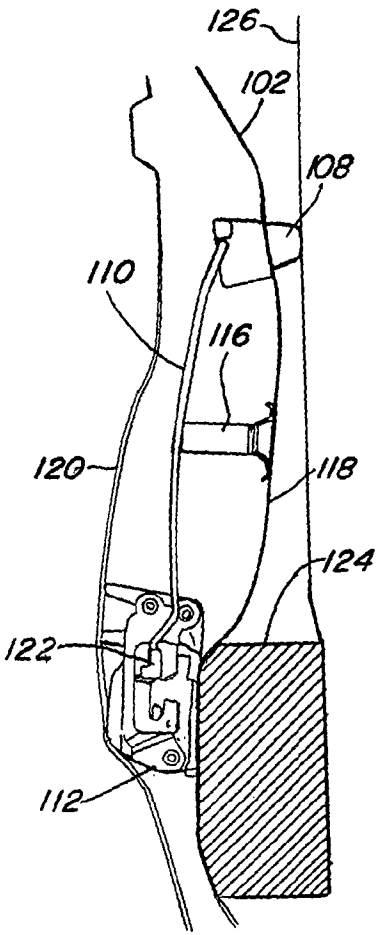
FIG. 6 is a side view of a door during an impact with an object according to an embodiment of the present invention.

FIG. 6 depicts the door 102 with greater deformation from the impact with the object 124. As can be seen in FIG. 6, the drive rod deformation member 116 is driven into the drive rod 110, and the drive rod deformation member 116 commences deforming the drive rod 110. In FIG. 6, the drive rod 110 is deformed by being bent.

Figure 7:
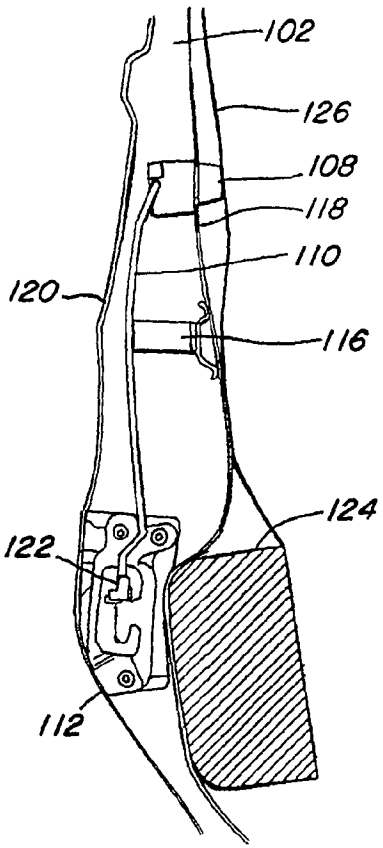
FIG. 7 is a side view of a door during an impact with an object according to an embodiment of the present invention.

FIG. 7 depicts the door 102 at a time after FIG. 6. As seen in FIG. 7, the drive rod 110 continues to be deformed by the drive rod deformation member 116. The drive rod 110, however, remains engaged with the door handle 108 and the latching system 112. The deformation of the drive rod 110 can correspond to the deformation of the door 102 and the reduction in distance between the door handle 108 and the latching system 112.

Figure 8:
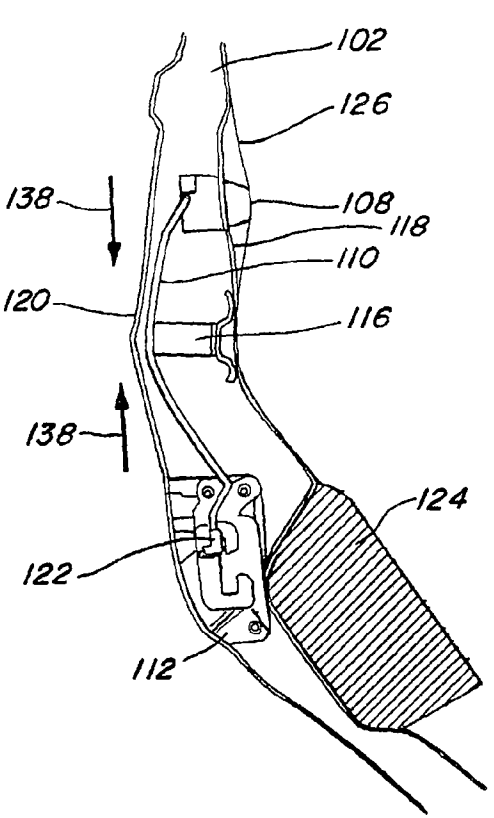
FIG. 8 is a side view of a door after an impact with an object according to an embodiment of the present invention.

FIG. 8 depicts the door 102 after the door 102 has completed its deformation from its impact with the object 124. As can be seen, the door 102 has suffered compression along the arrows 138. The door handle 108 is now closer to the latching system 112. Due to the deformation of the door 102, for example, along the arrows 138, the distance between the door handle 108 and the latching system 112 is decreased. In a conventional door 108, the drive rod 110 is not deformed. Since the distance between the ends of the drive rod 110 remains constant, the decrease in distance between the door handle 108 and the latching system 112 would cause the drive rod 110 to exert pressure on the latching system 112. This can cause the latching system 112 to disengage from the striker 106.

However, in the present invention, the drive rod 110 is deformed by the drive rod deformation member 116 and thus, the drive rod 110 does not cause the latching system 112 to disengage from the striker 106. Since the drive rod 110 is deformed, the distance between the ends of the drive rod 110 after deformation of the drive rod 110 is comparatively smaller than the distance between the ends of the drive rod 110 prior to deformation of the drive rod 110. This reduction in distance between the ends of the drive rod 110 compensates for the reduced distance between the door handle 108 and the latching system 112. Thus, the drive rod 110 does not actuate the latch release unit 122 and/or the latch unit 114 in the latching system 112 due to the compression along the arrows 138.

Furthermore, even though the drive rod 110 is deformed, the drive rod 110 can still be actuated by the door handle 108, allowing the door 102 to be opened when the door handle 108 is actuated. This can allow the user to easily exit the automobile 100 or allow a person outside the automobile 100 to easily access the user or material within the automobile 100. This can be useful in an accident where the user may want to exit the automobile 100 rapidly and/or a person such as a rescuer may want to access the user or materials within the automobile 100 rapidly without having to damage the door, remove the door, or find alternate means of exiting or accessing the automobile 100.

Figure 9:
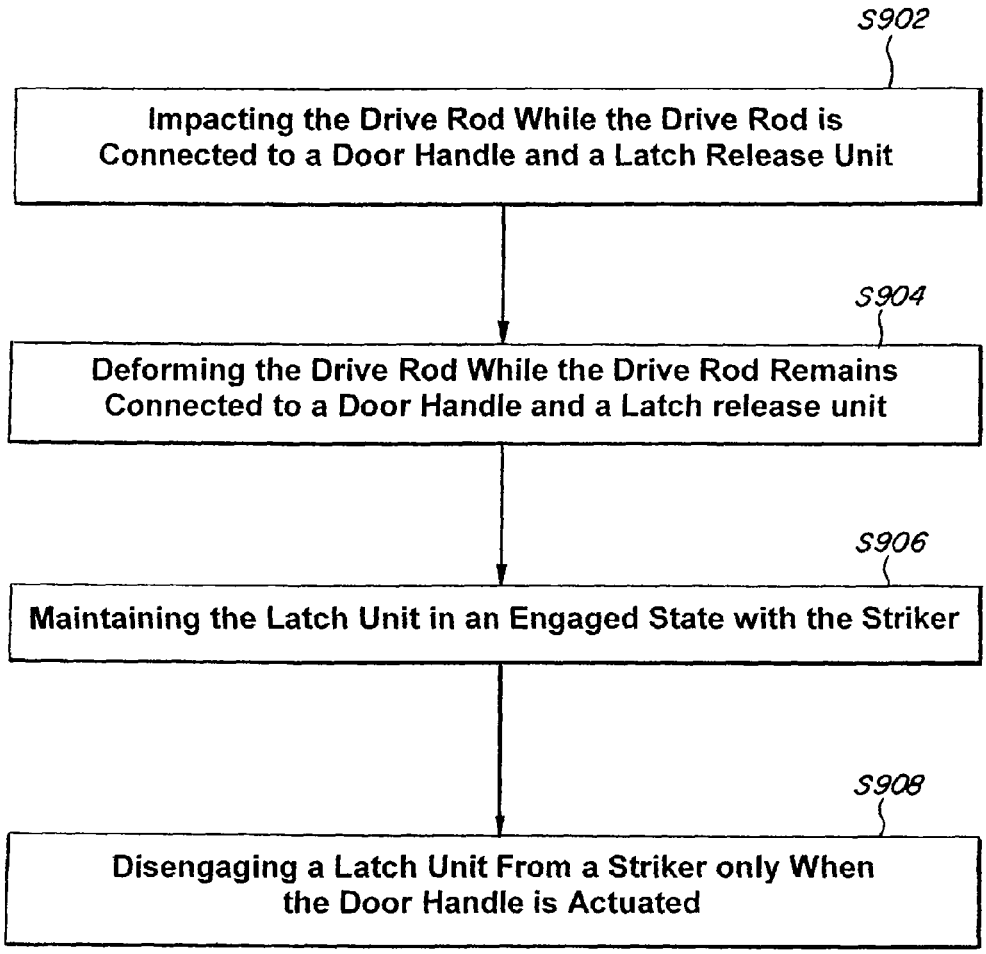
FIG. 9 is a flow chart for a process according to an embodiment of the present invention.

In one embodiment, the present invention is a process as disclosed in FIG. 9. In Step S902, the drive rod is impacted while the drive rod is connected to a door handle and a latch release unit. For example, the drive rod deformation member 116 can impact the drive rod 110 while the drove rod 110 is connected to the door handle 108 and the latch release unit 122. In Step S904, the drive rod is deformed while the drive rod remains connected to a door handle and a latch release unit. For example, the drive rod 110 can be deformed while the drive rod 110 remains connected to the door handle 108 and the latch release unit 122. The drive rod 110 can, for example, be bent.

In Step S906, the latch unit can be maintained in an engaged state with the striker. For example, the latch unit 114 can be maintained in an engaged state with the striker 106. In Step S908, the latch unit is disengaged from the striker only when the door handle is actuated. For example, the latch unit 114 is disengaged from the striker 106 only when the door handle 108 is actuated.

In one embodiment, the drive rod 110 can have deformation zones to allow the drive rod deformation member 116 to more easily deform the drive rod 110. The deformation zones in the drive rod 110 can be of any shape or size or configuration which allows the drive rod 110 to be deformed more easily by the drive rod deformation member 116. The deformation zones in the drive rod 110 can also be located along any portion of the drive rod 110 and on any side of the drive rod 110.

Figure 10:
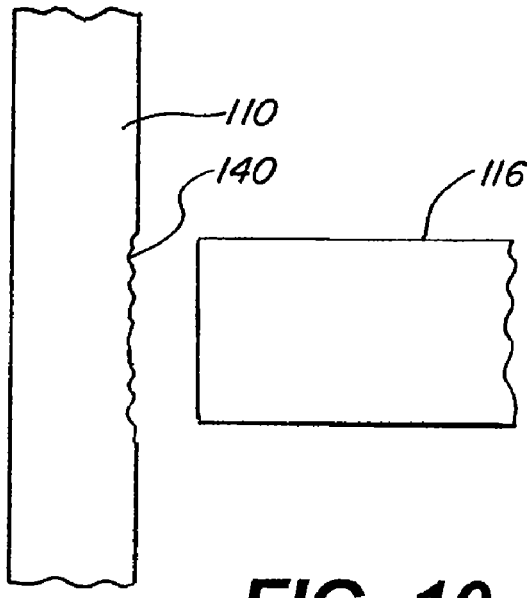
FIG. 10 is a side view of a drive rod with deformation zones according to an embodiment of the present invention.

As seen in FIG. 10, the deformation zones can include, for example, notches 140. The notches 140 allow the drive rod 110 to be deformed more easily, while still allowing the drive rod 110 to be rigid enough to actuate the latching system 112. The notches 140 can be located directly in front of an area where the drive rod deformation member 116 impacts the driver rod 110, or along any other portion of the drive rod 110.

Figure 11:
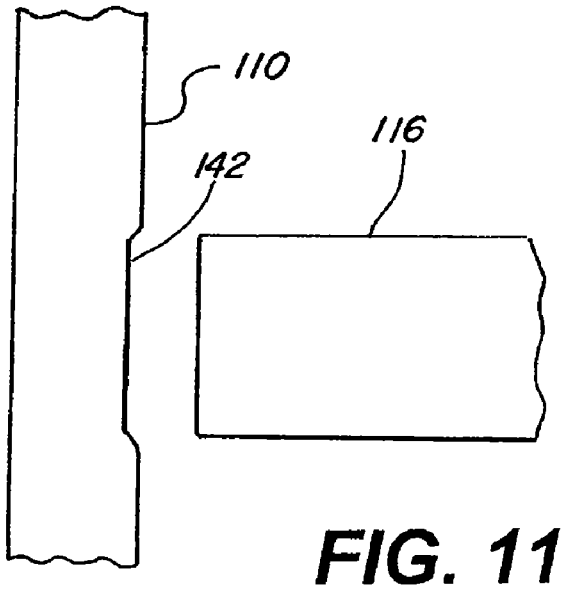
FIG. 11 is a side view of a drive rod with deformation zones according to an alternate embodiment of the present invention.

As seen in FIG. 11, the deformation zones can also include, for example, flat areas 142 in the drive rod 110. The flat zones 140 also allow the drive rod 110 to be deformed more easily, while still allowing the drive rod 110 to be rigid enough to actuate the latching system 112. The flat zones 142 can also be located directly in front of an area where the drive rod deformation member 116 impacts the drive rod 110, or along any other portion of the drive rod 110.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A door latch system comprising:

a door;

a door handle located on the door;

a latch release unit located in the door;

a drive rod engaged with the door handle and the latch release unit; and a drive rod deformation member located in the door, wherein upon impact to the door causing deformation to the door, the drive rod deformation member contacts the drive rod at a location along the drive rod between the door handle and the latch release unit and deforms the drive rod at the location along the drive rod between the door handle and the latch release unit, and wherein the drive rod remains engaged with the door handle and the latch release unit after the drive rod deformation member deforms the drive rod.

2. The system of claim 1 wherein the latch release unit is actuated by the drive rod only when the door handle actuates the drive rod.

3. The system of claim 1 wherein the door includes a panel, and the door handle and the drive rod deformation member are located on the panel.

4. The system of claim 1 wherein the door includes a first panel and a second panel opposing each other, and the door handle is located on the first panel and the drive rod deformation member is located on the second panel.

5. The system of claim 1 further comprising a latch unit engaged to the latch release unit, wherein the drive rod deformation member is mounted to the latch release unit.

6. The system of claim 1 further comprising:

a latch unit engaged to the latch release unit and actuated by the drive rod; and a striker selectively engaged with the latch unit based on the actuations of the drive rod, wherein the door is in a closed state when the latch unit is engaged with the striker, and the door is in an open state when the latch unit is disengaged from the striker.

7. The system of claim 6 wherein the door is in the closed state after impact to the door.

8. The system of claim 7 wherein the door is in the closed state until the drive rod is actuated.

9. An automobile comprising:

a frame;

a striker located in the frame; and a door connected to the frame and selectively engaged with the striker, the door including a latch unit selectively engaged with the striker, a latch release unit connected to the latch unit, wherein actuation of the latch release unit controls the engagement of the latch unit with the striker, a drive rod engaged to the latch release unit, a door handle engaged to the drive rod wherein the drive rod actuates the latch release unit based on a movement of the door handle, and a drive rod deformation member wherein upon impact to the door causing deformation to the door, the drive rod remains engaged with the door handle and the latch release unit, and the drive rod deformation member contacts the drive rod at a location along the drive rod between the door handle and the latch release unit and deforms the drive rod.

10. The system of claim 9 wherein the latch release unit is actuated by the drive rod only when the door handle actuates the drive rod.

11. The system of claim 9 wherein the door includes a panel, and the door handle and the drive rod deformation member are located on the panel.

12. The system of claim 9 wherein the door includes a first panel and a second panel opposing each other, and the door handle is located on the first panel and the drive rod deformation member is located on the second panel.

13. The system of claim 9 wherein the door is in a closed state when the latch unit is engaged with the striker, and the door is in an open state when the latch unit is disengaged from the striker, and the door is in the closed state immediately after impact to the door.

14. The system of claim 13 wherein the door is in the closed state until the drive rod is actuated by the door handle.

15. A method for deforming a drive rod in a door after an impact to the door comprising:

impacting the drive rod with a drive rod deformation member at a location along the drive rod between a door handle and a latch release unit while the drive rod is connected to the door handle and the latch release unit; and deforming the drive rod at the location along the drive rod between the door handle and the latch release unit while the drive rod remains connected to the door handle and the latch release unit.

16. The method of claim 15 wherein the step of deforming the drive rod includes bending the drive rod at the location of impact along the drive rod between the door handle and the latch release unit.

17. The method of claim 15 further comprising disengaging a latch unit from a striker only when the door handle is actuated.

18. The method of claim 17 further comprising maintaining the latch unit in an engaged state with the striker.

* * * * *